United States Patent [19]

Bass

[11] Patent Number: 4,551,108

[45] Date of Patent: Nov. 5, 1985

[54] EXERCISE DEVICE FOR USE IN TANK CONTAINING WATER

[76] Inventor: Eric Bass, 10 Walton Ave., Doylestown, Pa. 18901

[21] Appl. No.: 572,264

[22] Filed: Jan. 19, 1984

[51] Int. Cl.[4] ..... A63B 23/00

[52] U.S. Cl. ..... 441/116; 4/573; 272/1 B; 272/71; 272/99; 272/100; 441/136

[58] Field of Search ..... 4/571, 572, 573, 560, 4/565; 272/1 B, 71, 109, 99, 100; 434/247, 254; 128/365; 441/80, 84, 88, 106, 108, 111-119, 136

[56] References Cited

U.S. PATENT DOCUMENTS 3,449,778 6/1969 Jones ..... 441/112
3,835,815 9/1974 Matthews ..... 441/116

FOREIGN PATENT DOCUMENTS 2623091 11/1977 Fed. Rep. of Germany ..... 272/71

*Primary Examiner*—Sherman D. Basinger
*Attorney, Agent, or Firm*—Caesar, Rivise, Bernstein & Cohen, Ltd.

[57] ABSTRACT

A buoyant vest for use in a tank of water. The vest is made of a buoyant material. The vest has first vest loops attached adjacent the shoulder portions. The vest also has second vest loops attached adjacent the waist portion thereof. Adjustable security lines are attached between the vest loops and anchoring loops located on the tank. An exercise device comprises the combination of the vest and the tank.

3 Claims, 4 Drawing Figures

EXERCISE DEVICE FOR USE IN TANK CONTAINING WATER

This invention relates to an exercise device for use in tank containing water and more particularly to a new type of exercise device which can be used when a person cannot partially or fully support his or her weight.

It is known that exercise plays a very important role in maintaining good health. There are times when people are unable to partially or fully support the weight of their own body and thus vigorous exercise involving the use of legs becomes difficult or impossible.

For instance, there are various leg, hip and foot injuries normally suffered by athletes. Also, various diseases may temporarily or permanently affect the ability of a person to support his or her weight. Similar problems exist in many persons of advanced age.

In most cases the inability to support one's own weight exists because of the extreme pain encountered in the event of leg, hip and foot injuries or disease or concern for injury where a person of advanced age has so called brittle bones. There are also situations where there is concern that there will be injury or further injury in the course of normal exercise involving the use of the legs because of the shock or stress imposed upon the legs.

It has been determined through the present invention that shock or stress can be alleviated though exercising while immersed in water. In the present invention the buoyancy effect of the water eliminates some of the weight of the person with the additional weight being taken up by a buoyant harness used the present invention and security lines which connect the buoyant harness though anchored points on or beyond the tank containing the water.

The use of various holding devices for animals or humans in connection with bodies of water is known. See for instance U.S. Pat. No. 2,438,979 which shows a harness for bathing an animal in a bathtub. The harness of U.S. Pat. No. 2,438,979 involves a pair longitudinal bars detachably connected to cross bars with means at the ends of the cross bars for detachably securing the cross bars to the walls of the bathtub. A plurality of straps are adapted to be placed around the animal's body and means are provided to support the straps on the longitudinal bars.

U.S. Pat. No. 2,788,055 involves a baby bath tub safety device which is adapted for a bath tub installed within a bath room floor and walls. The bath tub safety device involves a vertical swivel tubular bearing support with means to enable such support to be rigidly attached to the bath tub floor and the bath tub wall. A swivel tubular extension support arm is adjustably and rotatably mounted within the vertical bearing support tube with the extension support arm being designed and formed to project above and over the bath tub and downwardly to the opposite tub wall. Means are rigidly attached to the opposite tub wall edge, with such means being designed and positioned to engage and retain the extension support arm.

The extension support arm is designed and formed to project above and horizontally over the bath tub and downward to the opposite tube wall edge. Spring means are mounted within the tubular bearing support engageable with the enclosed swivel support arm end section and are designed for supporting and displacing the same from the end lock notches when released. A spring latch means is mounted on the bearing support and also positioned engageable with the support arm end section for locking and releasing same in various predetermined positions.

U.S. Pat. No. 3,835,815 relates to a therapeutic conditioner for horses and encloses a water fillable open tank. A hoist and sling assembly is provided for the purpose of lifting and holding a horse in the tank while the horse swims. Guide ropes extend from the sling assembly to the periphery of the tank. The guide ropes serve to maintain the position of the horse relative to the tank.

While the foregoing devices serve to support the body of a human or animal in water, none of them provide the necessary added buoyancy effect to relieve the highly disturbing strain of the downward body weight to permit free exercise of the legs. This is quite significant where the person is suffering pain and disease or injury. Also, with the present invention there is the elimination of shock to the legs, hips, feet and back areas.

It is accordingly an object of the present invention to provide an exercise device for use in a tank containing water, which enables the carrying out of exercise when a person cannot support his or her weight.

Yet another object of the present invention is to provide an exercise device where the weight of a person is completely eliminated thereby also eliminating shock to the legs, hips, feet or back area.

Still another object of the present invention is to provide an exercise device that is economical to produce, can be readily assembled and can be conveniently disassembled and stored for further use.

The foregoing as well as other objects of the invention are aligned by providing an exercise device which basically comprises a tank holding water and a buoyant harness to be worn by a person. The buoyant harness possesses loops at the shoulders to enable securement of upper security lines to anchoring points out or beyond the tank. Additional loops are provided for further securement by security lines in the opposite or other senses as compared the first named security lines.

Attention is now called to the various figures of the drawing wherein.

Figure 2:
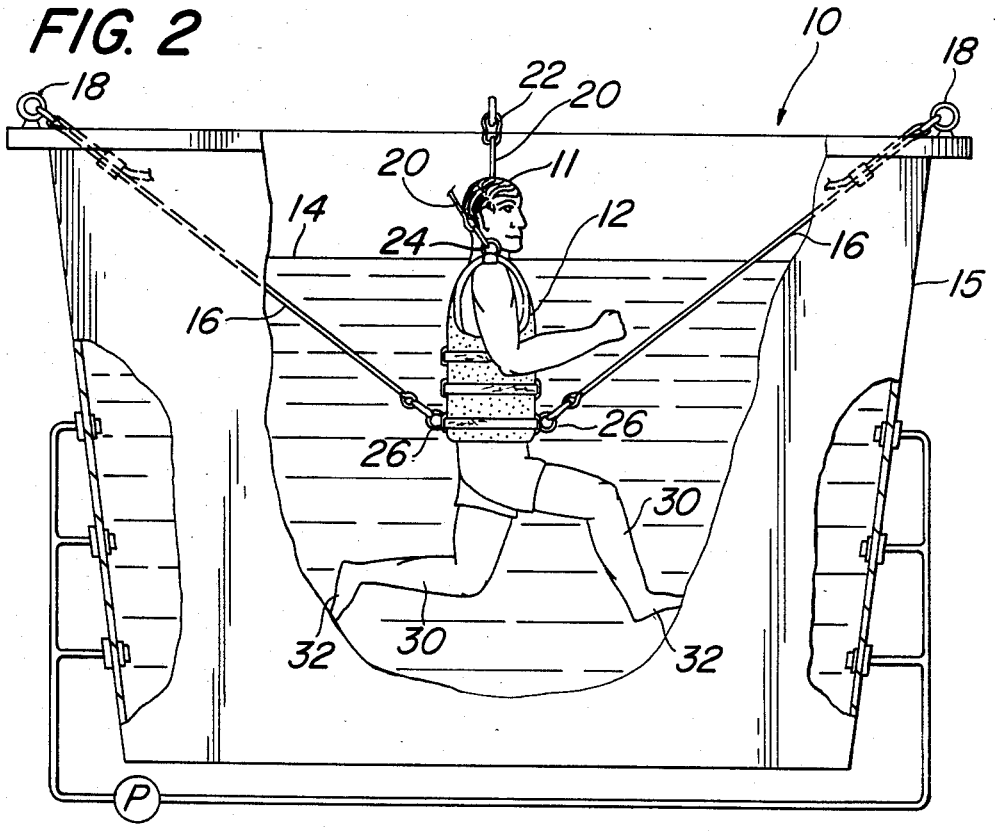
FIG. 2 is a side view partly in section of a tank showing a person wearing the buoyant harness of FIG. 1 and wherein the security lines are in place.
Figure 3:
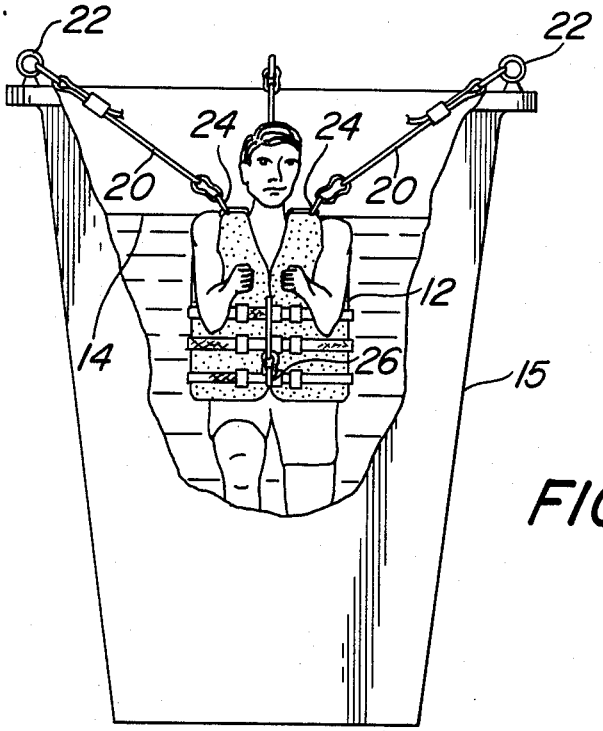
FIG. 3 is a view similar to FIG. 2 but taken from the opposite sense.
Figure 4:
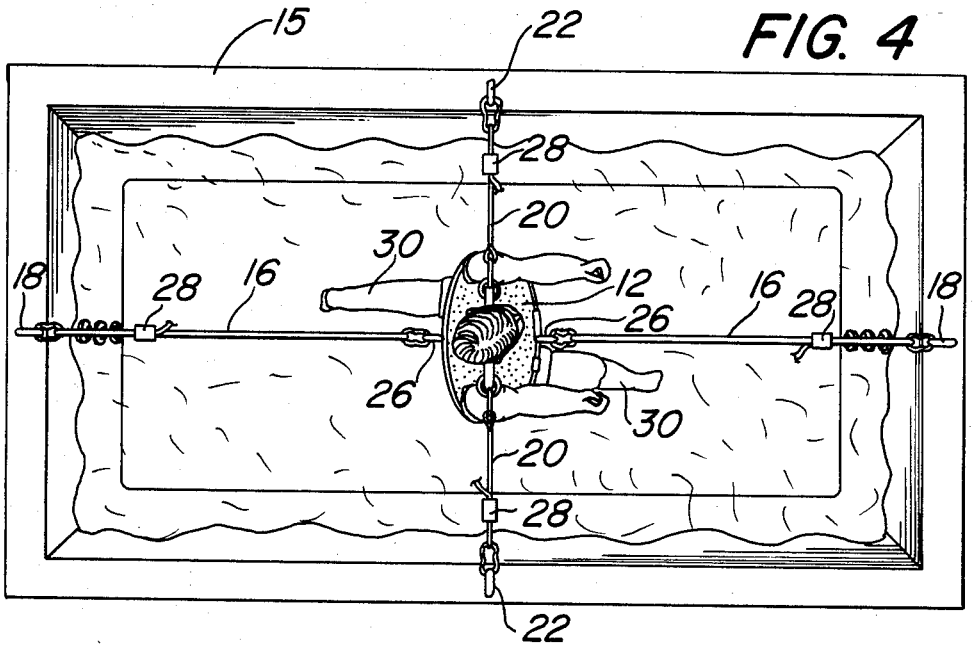
FIG. 4 is a top plan view of the device of FIG. 4.

Referring now to the various figures of the drawings wherein like reference characters refer to like parts there is shown at 10 in FIG. 2 an exercise device for use in tank containing water comprising a specific embodiment of the present invention. As can be further seen in FIG. 2 a person 11 wearing a buoyant vest 12 is exercising in tank 15, with water 14 being provided in the tank 10. It can seen that a first set of security lines 16 are provided for attachment to heavy, large anchoring loops 18 which are fixed at the top ledge of tank 10. A second set of security lines 20 (FIG. 3) are provided for attachment to heavy, large anchoring loops 22 that are also fixed at the top ledge of tank 10. The security lines are preferably made of a non-rusting metal, such as an aluminum alloy.

There are corresponding small anchoring loops on vest 12. See shoulder loops 24 and waist loops 26. Thus security lines 16 extend between loops 18 and 26 and security lines 20 extend between loops 22 and 24. Adjustment of the tension in the security lines is achieved by turnbuckles 28 or similar devices known to those in the wire or similar arts.

It should be further noted that the tank 14 is sufficiently deep so that the feet 32 extending from legs 30 of the person do not touch the bottom of the tank.

The actual suspension of the person 12 in the tank 14 is preferrably achieved though the use of four security lines, 16 and 20 although this number of security lines and their placement may vary, depending upon the circumstances.

Figure 1:
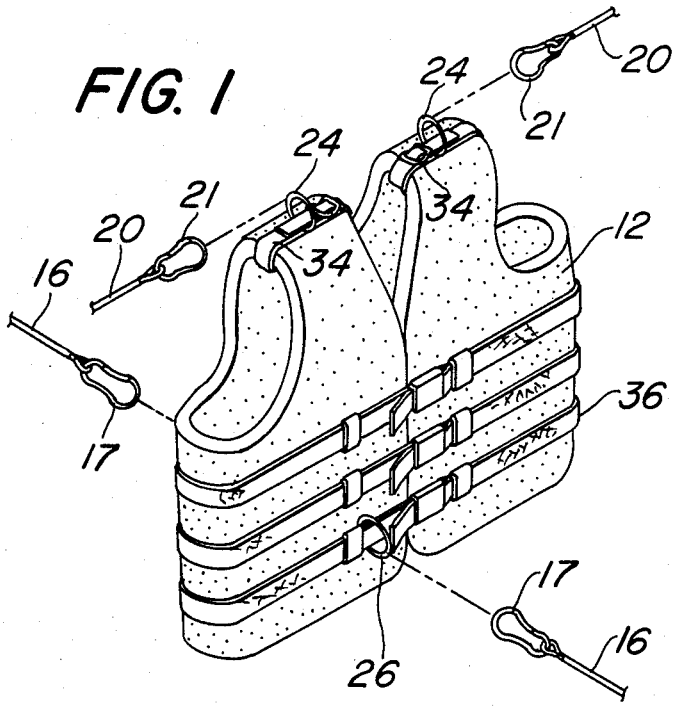
FIG. 1 is a three dimensional view showing the buoyant harness of the present invention as well as portions of the ends of security lines to be attached to the buoyant harness.

As shown in FIGS. 1 and 2 the buoyant vest or harness is provided with loops 24 similar to loops 26, at the shoulder lines. As can be further seen in FIG. 1 the loops 24 are generally held in place by means of inserted straps 34 possessing buckles to enable tightening or loosening to the desired degree. Also, as seen in FIG. 1, the ends of the security lines or cables may be provided with clasps or detachable loops 21 for securement to the vest loops 24 or 26.

Front and back loops 26 are provided as can best be seen in FIG. 2. These loops 26 are also held in place through one of the straps 36 in a manner similar to the shoulder loops 24. Clasps or detachable loops 17 for security lines 16 are similarly provided as can be seen in FIG. 1.

It is contemplated that the buoyant harness to be used in the present invention may be a harness of a material such as rigid polyurethane or rigid foamed polyurethane. Also, the vest of FIG. 1 has the desired number of body straps as well as providing the shoulder straps as seen in FIG. 1. The buoyant vest 12, preferrably has a buoyancy factor of at least 15.5 pounds (6.98 kilograms) and is basically of the one piece, front opening type as shown in FIG. 1.

With the foregoing arrangement a man, woman or child can be easily suspended for exercise in the tank 12. After the vest has been secured in place to the person, the security lines are attached at the various loops 24 and 26 on the vest 12 and to at least one of the loops 18 and 22. The person then supports himself or herself by holding on to side of the tank 15 while the security lines are engaged in the other loops 18 and 22.

It is also contemplated that the water in the tank will be heated and in some cases kept in motion by so-called whirlpool jets.

The security line length can be adjusted as desired which also has the effect of adjusting the tension in each security line. Once the person is comfortable with the degree of vertical support provided by the buoyancy in the vest and the tension in the security lines, exercise can begin. The tank should be sufficiently filled with water so that the legs do not touch the bottom of the tank and the person can move his or her legs completely and confidently in the water in a simulated walking or running action as well as complimentary arm movement.

The present invention may also be used with other bodies of water, such as a swimming pool wherein anchoring loops 18 and 22 are affixed at appropriate places along the sides of the swimming pool.

From the foregoing it can be seen that the present invention enables running or walking movement of a person while completely relieving the person of the necessity to support his or her weight. Accordingly, the present invention is quite significant for use where a person cannot partially or fully support his or her own weight and eleminates all shock during exercising.

Without further elaboration, the foregoing will so fully illustrate my invention that others may, by applying current or future knowledge, readily adapt the same for use under various conditions of service.

I claim:

1. A leg and body exercise device comprising a buoyant vest and a tank of water having sides and a bottom, said vest being made of a buoyant material and being adapted to be worn by a person in a upright running position in said tank, said vest having first vest loops attached adjacent the waist thereof, said tank having anchoring loops whereby adjustable security lines can be attached between said vest loops and said anchoring loops, said tank being of sufficient depth and being filled with sufficient water such that the exercising feet of the person do not touch the bottom of the tank.

2. The exercise device of claim 1 including shoulder loops attached adjacent the shoulder of the vest, with the tank having corresponding second anchoring loops whereby adjustable security lines can be attached between said shoulder loops and said second anchoring loops.

3. The exercise device of claim 1 wherein said vest is made of rigid polyurethane or rigid foam polyurethane.

* * * * *

US004551108B1

REEXAMINATION CERTIFICATE (3068th)

United States Patent [19]

Bass

[11] B1 4,551,108

[45] Certificate Issued Dec. 3, 1996

[54] EXERCISE DEVICE FOR USE IN TANK CONTAINING WATER

[75] Inventor: Eric Bass, Doylestown, Pa.

[73] Assignee: Therapeutic Systems, Inc., Doylestown, Pa.

Reexamination Request:
No. 90/004,124, Jan. 24, 1996

Reexamination Certificate for:

| | |
|---|---|
| Patent No.: | **4,551,108** |
| Issued: | **Nov. 5, 1985** |
| Appl. No.: | **572,264** |
| Filed: | **Jan. 19, 1984** |

[51] Int. Cl.[6] ..... A63B 23/00

[52] U.S. Cl. ..... 482/69; 441/116; 441/136; 482/55; 482/111

[58] Field of Search ..... 441/116; 482/69

[56] References Cited

U.S. PATENT DOCUMENTS

| | | | |
|---|---|---|---|
| 339,650 | 4/1886 | Hill . | |
| 518,967 | 5/1904 | Poole . | |
| 793,288 | 6/1905 | Faber . | |
| 1,002,558 | 9/1911 | Bressler | 441/88 |
| 1,056,374 | 3/1913 | Smith . | |
| 1,329,660 | 2/1920 | Kaye | 434/254 |
| 1,901,906 | 3/1933 | Farmer et al. . | |
| 2,434,543 | 1/1948 | Borroughs . | |
| 2,438,979 | 4/1948 | Short | 4/573.1 |
| 2,788,055 | 4/1957 | Tumas . | |
| 2,825,224 | 3/1958 | Lindernauer et al. . | |
| 3,068,001 | 12/1962 | Portman et al. . | |
| 3,068,002 | 12/1962 | Balne . | |
| 3,068,003 | 12/1962 | Portman et al. . | |
| 3,174,702 | 3/1965 | French . | |
| 3,369,809 | 2/1968 | Morrill, Jr. . | |
| 3,449,778 | 6/1969 | Jones | 9/341 |
| 3,512,416 | 5/1970 | Hohwart . | |
| 3,646,626 | 3/1972 | Frieder | 9/342 |

(List continued on next page.)

FOREIGN PATENT DOCUMENTS

| | | |
|---|---|---|
| 552122 | 6/1931 | Germany . |
| 1190849 | 4/1965 | Germany . |
| 2623091 | 11/1977 | Germany . |
| 2821029 | 12/1978 | Germany . |
| 330482 | 7/1930 | United Kingdom . |

OTHER PUBLICATIONS

APCO Atlantic Pacific–of Newark NJ 07014–Type IV PFD–Federal Regulations Requiring Personal Flotation devices, 1 page.

Licht, et al., Medical Hydrology (1963), Waverly Press, pp. v and 192–194.

Finnerty and Corbitt, Hydrotherapy (1960), Frederick Ungar Publishing Co., p. 72.

Ille Electric Corp. Catalog, Hydromassage Subaqua Therapy Equipment, (1958).

Ille Corp. Catalog, (1979), "Ille Electro Therapeutic Equipment".

*Primary Examiner*—Sherman Basinger

[57] ABSTRACT

A buoyant vest for use in a tank of water. The vest is made of a buoyant material. The vest has first vest loops attached adjacent the shoulder portions. The vest also has second vest loops attached adjacent the waist portion thereof. Adjustable security lines are attached between the vest loops and anchoring loops located on the tank. An exercise device comprises the combination of the vest and the tank

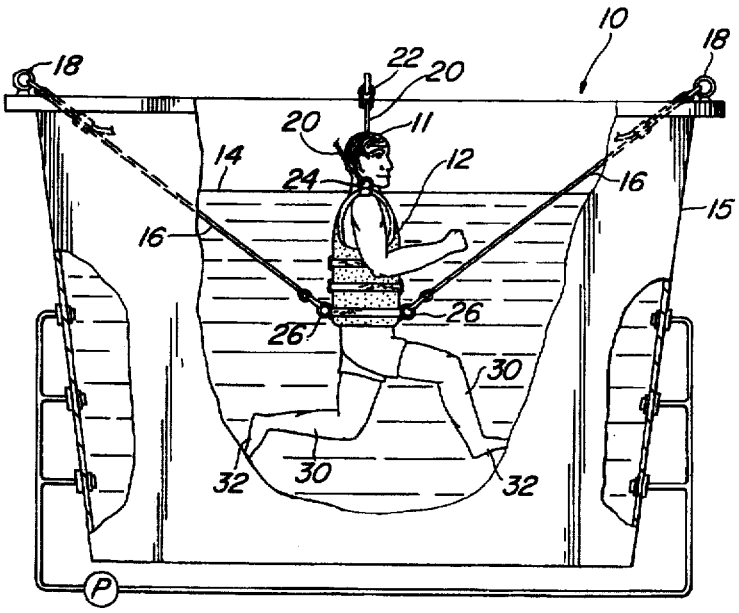

U.S. PATENT DOCUMENTS

| | | | |
|---|---|---|---|
| 3,708,167 | 1/1973 | Potgieter | 272/58 |
| 3,772,719 | 11/1973 | Ohnaka | 9/307 |
| 3,780,663 | 12/1973 | Petitt et al. | 104/1 R |
| 3,835,815 | 9/1974 | Matthews | 119/158 |
| 3,843,119 | 10/1974 | Davis | 272/79 R |
| 3,861,675 | 1/1975 | Hopper | 272/71 |
| 3,910,573 | 10/1975 | Jambs | 272/79 R |
| 3,929,331 | 12/1975 | Beeding | 272/79 D |
| 3,988,020 | 10/1976 | Carter | 272/125 |
| 4,047,255 | 9/1977 | Kiefer | 9/337 |
| 4,109,907 | 8/1978 | Zito | 272/117 |
| 4,114,874 | 9/1978 | Mattila | 272/71 |
| 4,194,257 | 3/1980 | Martin et al. | 9/342 |
| 4,247,096 | 1/1981 | Schmitt | 272/71 |
| 4,248,419 | 3/1981 | Hobwart | 272/71 |
| 4,380,441 | 4/1983 | Harr | 441/112 |
| 4,443,204 | 4/1984 | Perrin | 441/129 |
| 4,477,073 | 10/1984 | Koch et al. | 272/93 |
| 4,479,647 | 10/1984 | Smith | 272/117 |
| 4,527,795 | 7/1985 | Zink | 272/71 |
| 4,530,497 | 7/1985 | Moran et al. | 272/71 |
| 4,551,107 | 11/1985 | Scheurer et al. | 441/112 |
| 4,552,540 | 11/1985 | Bass | 441/129 |
| 4,577,859 | 3/1986 | Gossett | 272/71 . |

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–3 is confirmed.

* * * * *